United States Patent [19]

Hubert

[11] 4,365,252

[45] Dec. 21, 1982

[54] CORRECTION METHOD FOR TRANSVERSE DEFOCUSSING OF PARABOLIC ANTENNA

[75] Inventor: Bernard Hubert, Le Cannet, France

[73] Assignee: Societe Nationale Industrielle Aerospatiale, Paris, France

[21] Appl. No.: 212,663

[22] Filed: Dec. 3, 1980

[30] Foreign Application Priority Data

Dec. 18, 1979 [FR] France ..... 79 30957

[51] Int. Cl.[3] ..... H01Q 3/12; H01Q 19/12

[52] U.S. Cl. ..... 343/761; 343/766; 343/840

[58] Field of Search ..... 343/761, 762, 765, 766, 343/840, DIG. 2

[56] References Cited

U.S. PATENT DOCUMENTS

| | | | |
|---|---|---|---|
| 3,166,750 | 1/1965 | Ball | 343/705 |
| 3,262,321 | 7/1966 | Moul | 343/765 |
| 3,333,269 | 7/1967 | Vilbig et al. | 343/100 ST |
| 3,374,977 | 3/1968 | Moy et al. | 248/163 |
| 3,565,515 | 2/1971 | De Mey | 343/761 |
| 3,680,141 | 7/1972 | Karikomi | 343/761 |

FOREIGN PATENT DOCUMENTS

| | | | |
|---|---|---|---|
| 517664 | 3/1955 | Italy | 343/761 |
| 905440 | 9/1962 | United Kingdom | 343/756 |

*Primary Examiner*—Eli Lieberman

*Attorney, Agent, or Firm*—Karl W. Flocks; A. Fred Starobin

[57] ABSTRACT

A correction method for transverse defocussing of paraboloid oriented relative to the source initially aligned with the focus consists of securing said paraboloid to first platform, articulating said first platform through hinge means jointed to second platform, itself articulated through further hinge means jointed to a stationary part, and then orienting said hinge means to said focus, while providing moving means for said platforms, said moving means being servocontrolled responsive to pointing error detector thereby to hold permanently said focus close to the source.

Provision is also made of a parabolic antenna comprising means for carrying out said method. The system is applied to radio and TV broadcast apparatus aboard satellites.

8 Claims, 10 Drawing Figures

CORRECTION METHOD FOR TRANSVERSE DEFOCUSSING OF PARABOLIC ANTENNA

The orientation of a parabolic antenna beam and generally of a paraboloid can be obtained according to different methods.

When the source is rigidly connected to the paraboloid the assembly can be pivoted about the reference axes.

This can be the case with parabolic antennae mounted aboard a satellite the whole body of which is then stabilized in a given pointing direction.

The whole of the source-paraboloid assembly can also be constituted as a base oriented with respect to its support.

This solution is usually applied for example to surveillance radars.

Finally, the paraboloid can be oriented relative to the source but in this case there appears a phenomenon of defocalization both in the axial and transverse directions resulting from the pivoting point no longer permitting subjection of the paraboloid focus to the source.

The latter case, however, is the only one that can be retained when, for example, on a radiobroadcasting satellite in which power losses must be reduced at the transmission, it is necessary to secure the horn containing the source directly to the satellite body itself.

Thus,the satellite is roughly stabilized on the orientation axis, and a fine-pointing system brings the paraboloid focus to the sighted direction.

Such systems are well known in themselves and an example thereof is shown in the Applicant's U.S. patent application Ser. No. 160,810 entitled: "Satellite antenna orientation control method and sensor configuration applying said method".

According to said U.S. patent application, the antenna is connected to a platform orientable with respect to the satellite, and the orientation device substantially consists of a particular electromagnetic system having the advantage of eliminating frictions generative of disturbing torques and described in the Applicant's other U.S. patent application Ser. No. 125,058, entitled: "Electromagnetic process for controlling orientation of a platform and platform for carrying out said process".

Although such systems might properly solve problems connected with frictions due to the absence of any mechanisms, they cannot avoid the above-mentioned defocalization phenomenon which inherently is produced by the virtual rotation point of the paraboloid being located behind the latter, hence much behind the focus.

There could also be envisaged such a device permitting attenuation of the defocussing by means of a tripod or tetrapod system of the type such as described in for instance the U.S. Pat. No. 3,871,778.

In such design, the source-paraboloid assembly may be symbolically represented by a truncated pyramid having a triangular or square base, wherein the fixed source would be at the top of said pyramid and the paraboloid directrix perpendicular to the plane of the truncated portion; the base being in its turn secured to the fixed portion.

The truncated part is thus connected to the base through axially deformable elements centered on the edges thereof; then, upon rotation of the connecting points, displacement of the sides of said truncated portion can be obtained, substantially in the plane through the lateral faces of said pyramid, thereby to cause minimum deviation between the focus and the source.

Unfortunately, in such a device the axial torsion stiffness remains very low thereby requiring, for example, complementary parallelogramic means such as those described in the above-mentioned U.S. patent.

Moreover, if the system is tripodal it is necessary to combine the pointing error detections for controlling the orientation motors but this requires a coupling of the axes in X and Y.

Finally, the application of the electromagnetic methods disclosed in the Applicant's above-mentioned U.S. patent application Ser. No. 125,058 would be little compatible with such tripodal or tetrapodal systems because of the resulting significant axial deflection, which proportionally reduces the effectiveness of the installation due to the amplitude of the required gaps.

Consequently, the object of the invention is to provide a method of correcting the transverse defocalization of a paraboloid which does not present any of the above-mentioned inconveniences.

In accordance with the invention, the paraboloid is supported on a first platform transversely articulated according to a deformable trapezium and said first platform is articulated orthogonally to a second platform articulated according to a deformable trapezium connected with a fixed base.

In this way, under the action of suitable servo-controlled motive means acting independently upon transverse motions of the platforms, the focus of the paraboloid may remain substantially merged into the source with a negligible second degree error which is in practice neglected, but will be, however, explicited hereinafter.

The invention will be better understood in the following description showing a preferred exemplifying form of embodiment of the invention as a parabolic antenna reflector for satellite, in the light of the attached drawings, in which.

Figure 4A:
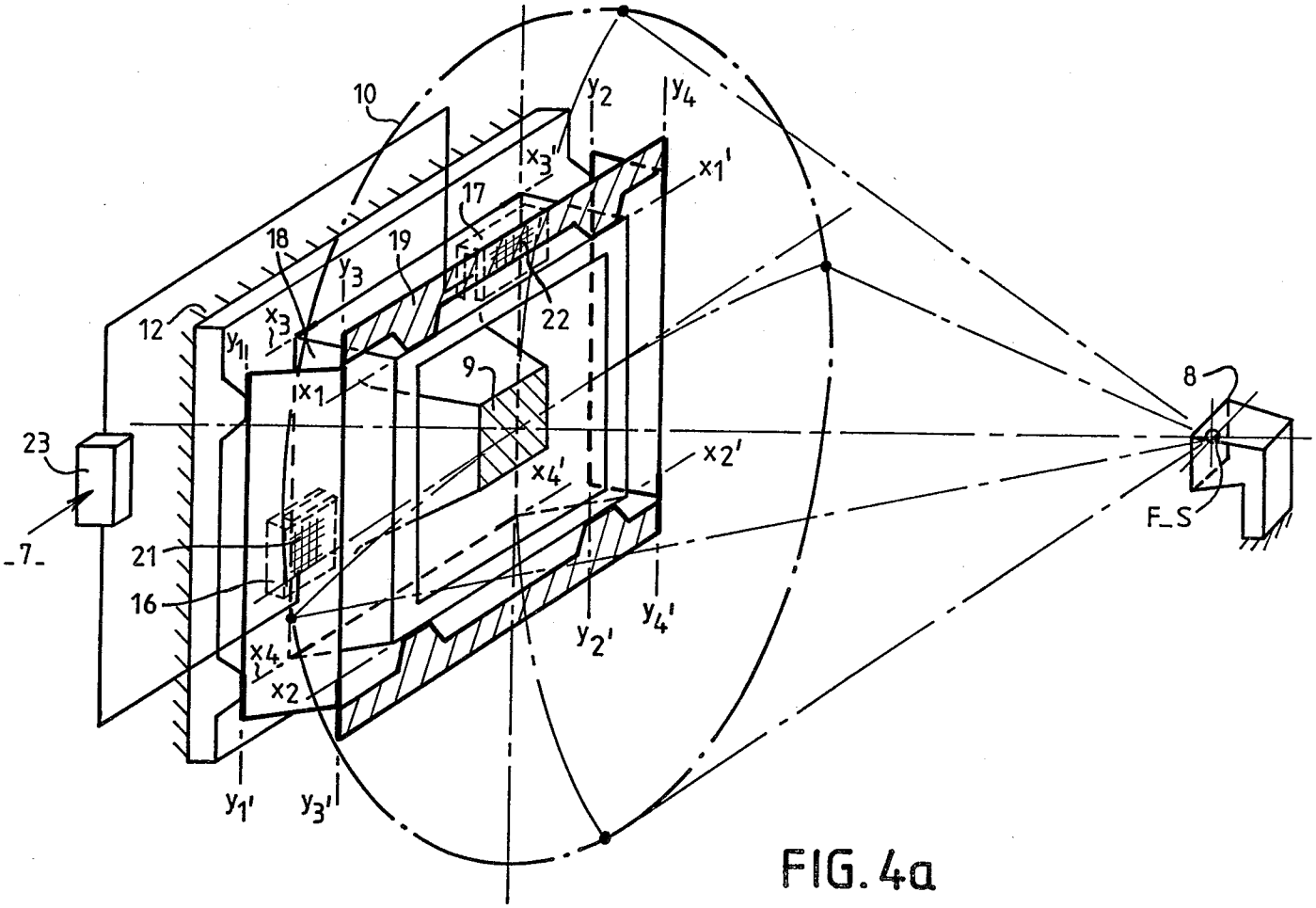
Figure 4B:
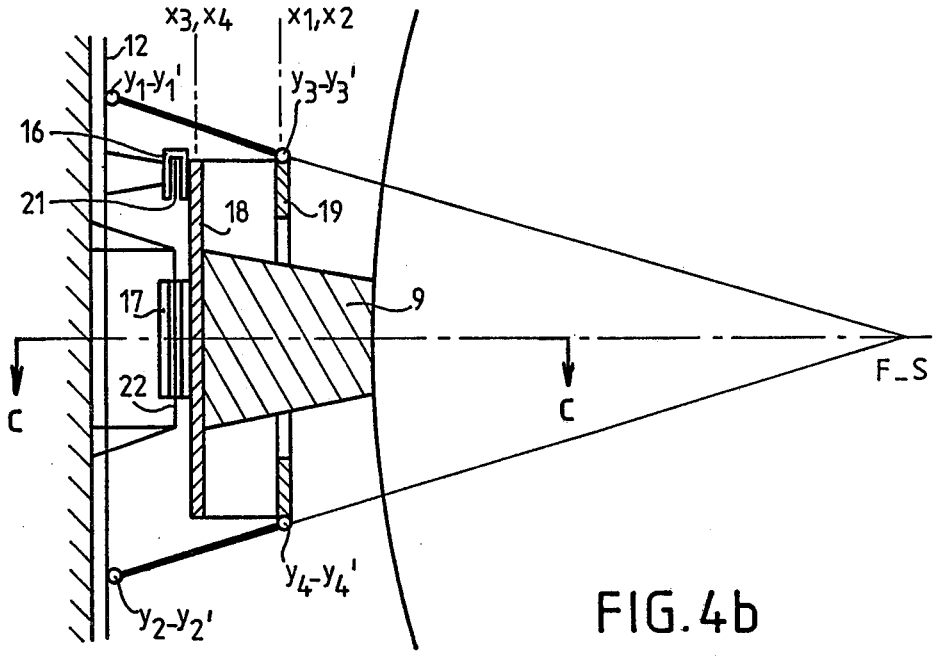
Figure 4C:
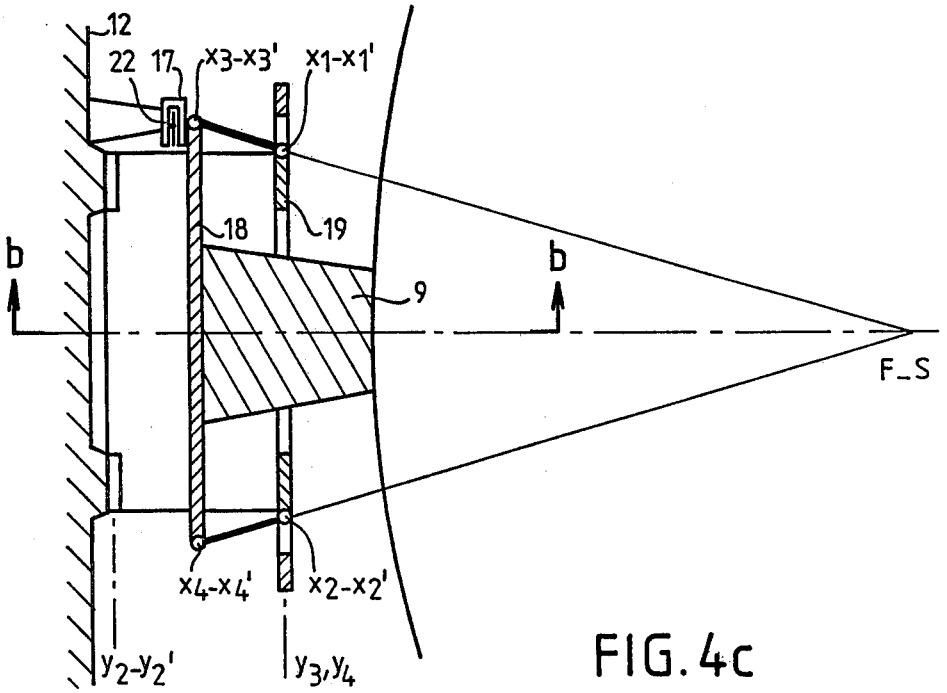
Figure 5:
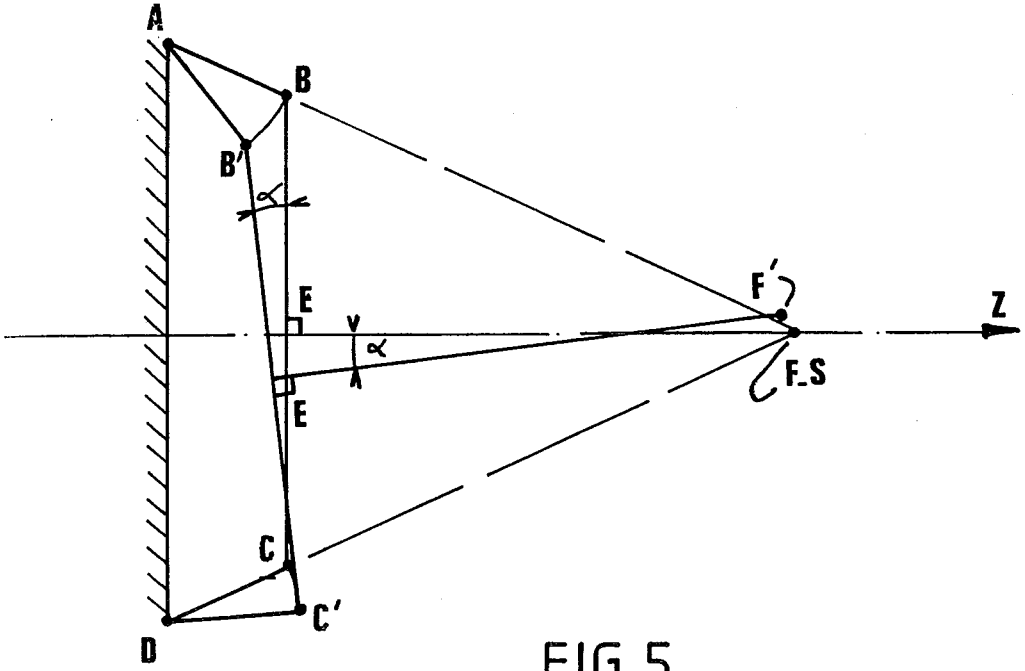
Figure 6:
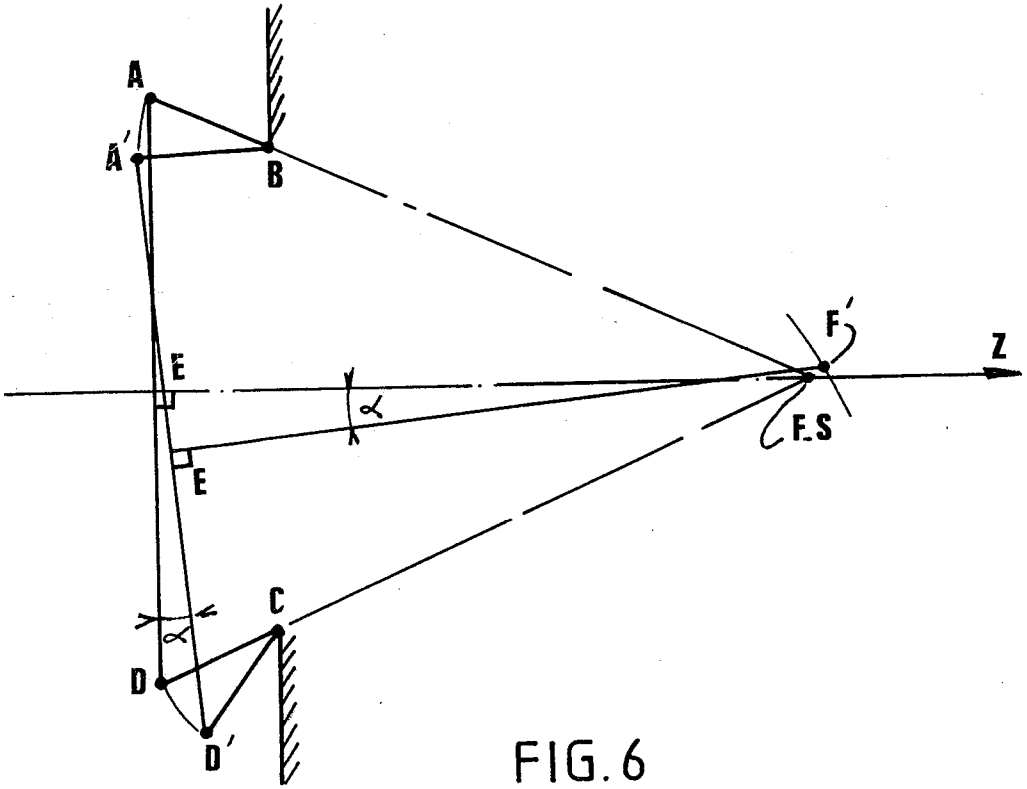
Figure 7:
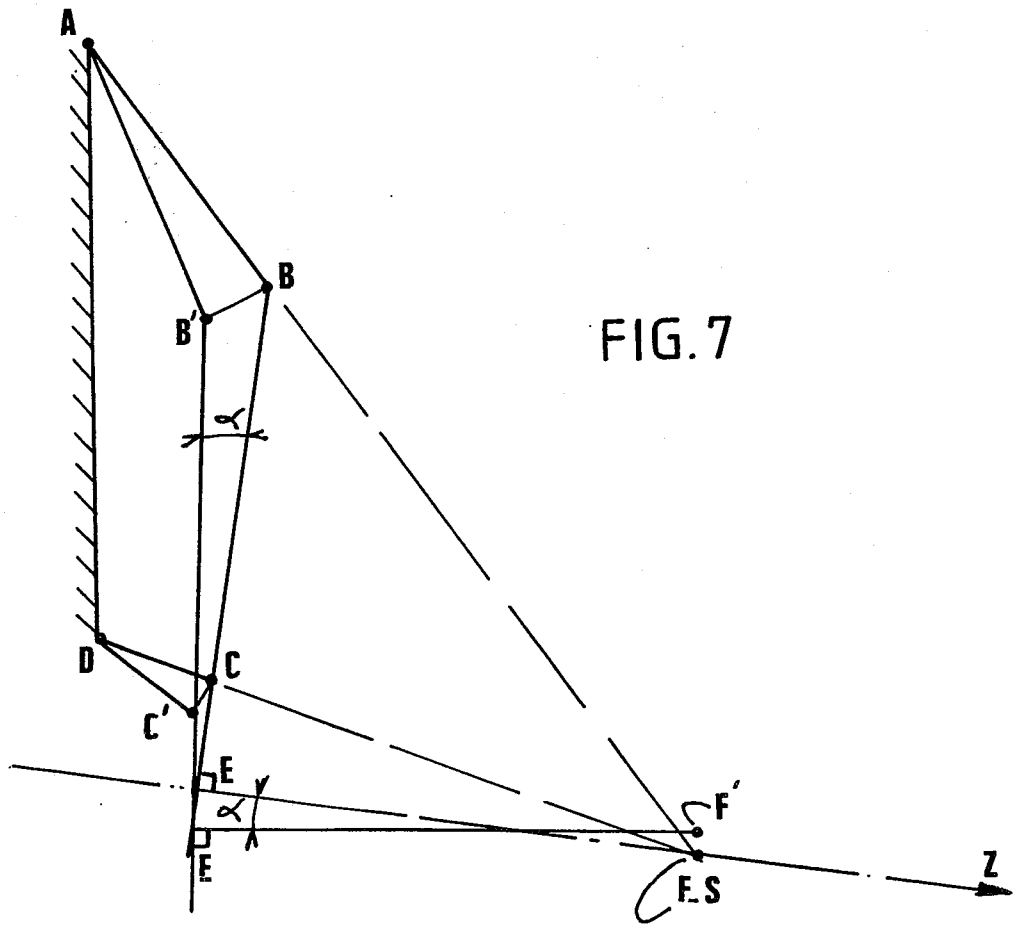
Figure 8:
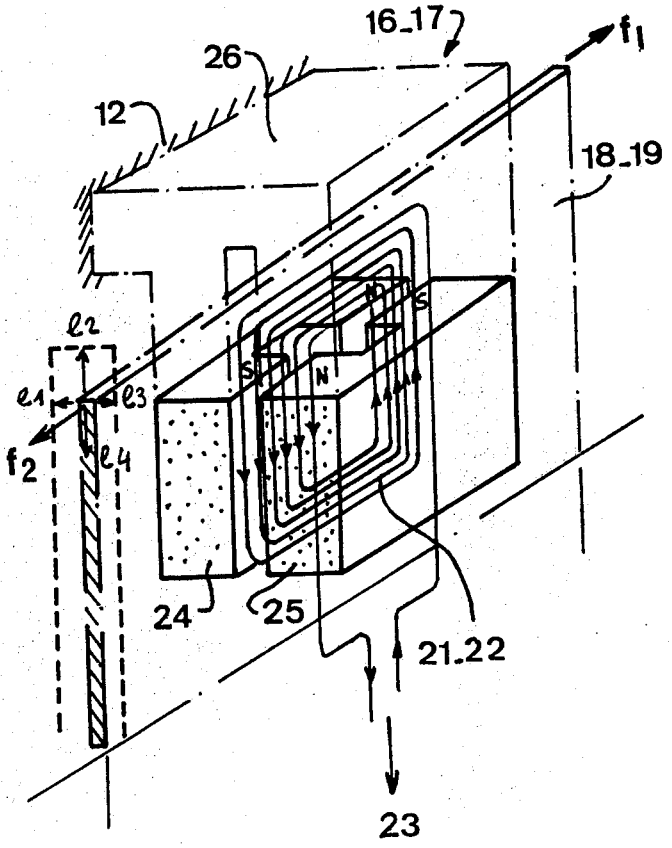

FIG. 4*a* is a schematical perspective view showing means used according to the invention for correcting transverse defocussing of a paraboloid, and FIGS. 4*b* and 4*c* are plane sections of the device of FIG. 4*a* along x—x and y—y axes respectively;

FIG. 5 is a schematical geometrical view showing how the transverse defocussing correction is obtained according to a first realization of the invention;

FIG. 6 is a schematical geometrical view showing how the transverse defocussing correction is obtained according to a second realization of the invention;

FIG. 7 is a schematical geometrical view showing how the transverse defocussing correction is obtained in a third form of realization of the invention, and FIG. 8 is a schematical perspective view showing known electromagnetic means for moving the platforms.

Figure 1:
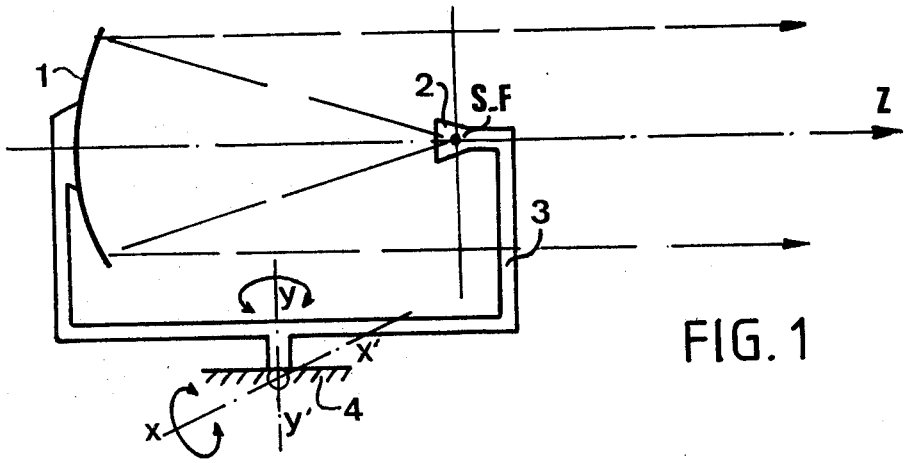
FIG. 1 is a schematical sectional view representing a source connected to a paraboloid, such assembly being secured to the body proper.

Referring to FIG. 1, paraboloid 1 is connected through the frame 3 to the source S of the horn 2, which is located at the focus F and the directrix Z is oriented by pivoting of the body 4 about axis XX'and/or YY'.

Figure 2:
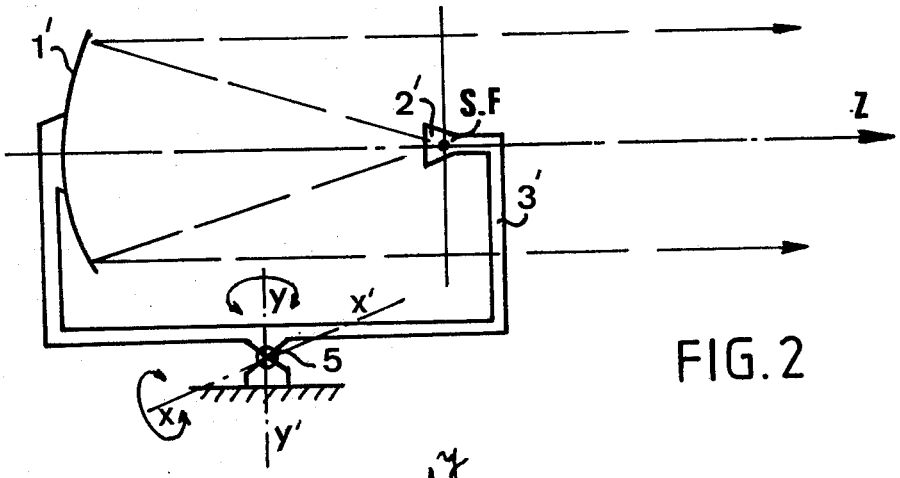
FIG. 2 is a schematical sectional view representing a source connected to the paraboloid, such assembly being pivotable on the body proper.

Referring to FIG. 2, paraboloid 1' is connected by the frame 3' to the source S of horn 2' located at the focus F, and the directrix Z is oriented by pivoting knuckle 5 about axes XX' and/or YY'.

Figure 3:
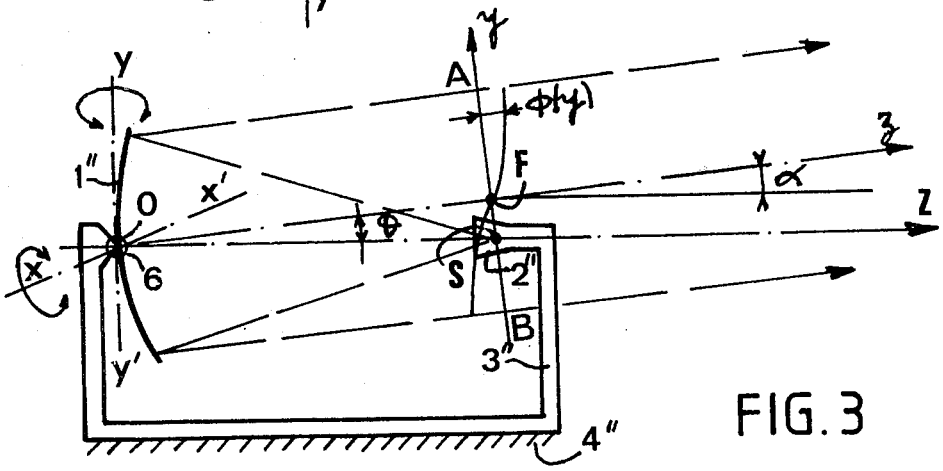
FIG. 3 is a schematical sectional view representing a source not connected to the paraboloid, itself orientable with respect to the body proper.

Referring now to FIG. 3, it may be noted on the contrary that when paraboloid 1'' must be oriented according to 6 in X and Y, with respect to frame 3'' connected to the source S of horn 2'', problems are raised essentially with regard to transverse defocussing.

Leaving aside the axial defocussing which remains relatively low, the importance of said transverse defocussing can be analyzed by referring to Leo THOUREL's study in "Les Techniques de l'Ingenieur" ref. E 3086, page 11: in which it is stated: "If the horn (containing the source S) is moved according to a line perpendicular to the symmetrical axis, and passing through the focus F, the corresponding phase shift is an odd function and a deviation of the maximum radiation direction appears therein.

If the phase centre is at S, the direction S0 making an angle $\theta$ with 0z, there results a phase shift $\phi(y)$ on the opening AB, thereby producing a beam deflection . . . and dissymmetry in the radiation diagram . . . ; a significant secondary lobe appearing in the side opposite to the deflection (coma lobe).

The defocalization always results into losses in the antenna gain because the beams flare, since the radiations reflected from the reflector are no longer parallel."

In certain spatial applications, according to FIG. 3, the body 4'' of the satellite is oriented according to 0Z by its own attitude correction means, while pointing along 0Z is obtained by suitable means through a correction about axes XX' and/or YY', according to the articulation point 0 located in 6, hence revealing the transverse defocalization defect mentioned above.

Thus, for, e.g., the satellite INTELSAT 5, a value of $\alpha=5°$ has been admitted.

On the contrary, in the radiobroadcasting satellites in which very severe regulations apply thereby limiting strictly the beam pattern transmitted, a value of $\alpha$ of 1° tolerated to within $\pm 0.02°$ is imposed thereon, so as to practically correspond to about $\pm 1$ mm of transverse defocussing between the focus and the source, but this cannot be obtained by presently known means.

To this end, one object of the invention is a method of correcting transverse defocalization of a parabolic antenna, which does not present the above-mentioned deficiencies.

According to the invention, the focus F of the paraboloid is maintained in the immediate proximity of the source S, because point 0 is moved transversely of the pointing axis SZ by means of a device schematically shown on FIG. 4 and the basic principle of which is exposed on FIG. 5 or as variations thereof on FIGS. 6 and 7.

Referring to FIGS. 4*a*, 4*b*, and 4*c* the paraboloid 10 having a focus F centered in S is connected by a pylon 9 to a first platform 18 in form of a trapezium articulated about axes XX' according to A-B-C-D on FIG. 5.

The sides AB and CD are disposed in the resting position in the direction of the merging points F and S.

The first platform is articulated to a second platform 19 in form of a trapezium articulated to the base 12 about axes Y—Y' according to A,B,C and D of FIG. 5.

It will be easily understood that when the articulated trapezium formed by platform 18 or platform 19 is pivotably moved about articulation axes X1,X1' ,X3,X3' and X2,X2' ,X4,X4' for platform 18, and Y1,Y1' , Y3-,Y3' and Y2,Y2' ,Y4,Y4' for platform 19, the focus F of paraboloid 10 will be moved toward F' in accordance with that which is shown in FIG. 5.

Referring to FIG. 5, rotation of the straight line BC about point F is obtained by deformation of the articulated trapezium ABCD and such deformation A.B'.C'D permits conjugation of rotation and translation of the straight line BC in such way that the motions of point F on the mediatrix of BC remain low during such motion.

Thus, through a rotation of BC about E only, point F would move by $d \simeq EF\alpha$.

In the present case, point F will move into F' by a quantity $d \simeq k\alpha^2$, i.e. a term of the second order in $\alpha$, if, obviously, both of AB and DC initially converge toward point F.

Referring to FIG. 6, in a form of realization similar to FIG. 5, the base BC is fixed, whereas base AD is deformable according to A'D'. Also here, F will move into F' by a quantity $d \simeq k\alpha^2$, i.e., a second order term in $\alpha$, if of course AB and DC initially converge toward F.

FIGS. 5 and 6 represent the cases when BC and AD are initially parallel.

Other cases where they would no longer be parallel are conceivable as for example on FIG. 7, but the initial convergence of AB and DC in F should however be preserved.

Of course, the sighting straight line F-S→Z in all cases remains initially perpendicular to the straight line BC, i.e., E=90°.

The shift of focus F into F' results from the usual geometrical laws which will not be exposed here.

It must only be observed that such shifting movement results from a second order term which always remains within practically acceptable limits. Thus, by suitable selection of parameters, a defocalization lower than 1 mm can be obtained with an angle $\alpha$ close to 1° which is appropriate for a radiobroadcasting satellite antenna.

It must also be noted that a slight convergence anomaly of AB and CD forwardly or rearwardly of F-S is not redhibitory with regard to application of the method according to the invention, as only the search for reducing the defocalization F→F' must guide the choice in adaptation of parameters.

In the same line of thought, for particular applications, a differing choice of convergence point for one platform as compared to the other could also be determined.

Referring again, to FIGS. 4*a*, 4*b*, and 4*c*, it can be seen that platforms 18 and 19 are moved orthogonally by means of electromagnetic devices servo-controlled to a detector of pointing errors thereby leaving room for a high torsion stiffness of the assembly.

Such electromagnetic devices could be of the type described in the above-mentioned U.S. patent application Ser. No. 125,058, denoted as 16, 17 on FIGS. 4*a*, 4*b*, and 4*c* and repreented on a larger scale on FIG. 8, and which basically function as explained hereinbelow.

Each platform 18 or 19 carries a flat winding located in its plane and the wires of which are in the direction of movement. Said windings 21 and 2 are connected to a servo-control unit 23 connected to a pointing error detector 7 (not shown).

The signal commands being thus decoupled, each winding sees the direction of current flow established, for example, along the arrows of FIG. 8.

Each winding is bestridden by a pair of magnets 24,25 of reversed polarity which are secured to the fixed base 12 by a support 26. The arrangement of the magnets and windings can be reversed with the same result.

Depending on the direction of current flow and the intensity thereof, each platform 18 or 19 will move in the magnetic field in the direction of arrows F1 or F2 with more or less amplitude in conformity with Laplace's law.

In this way, the direction and amplitude of the motions of each platform will depend on the direction and intensity of the current supplied to each winding.

As the translation of the platform is not effected strictly in one plane, a deflection space (arrows e1,e2-,e3,e4) must obviously be reckoned with for each platform.

Two devices for each platform may also be supplied without the concept of realization of the invention being however modified, each of said devices being then electrically coupled in parallel to the unit 23 (or in redundance).

It must also be noted that with paraboloids used in the electromagnetic microwave domain, the source of transmission and/or reception consists in a known manner of a waveguide horn 8 having a progressively increasing cross-section and connected with the fixed base.

The paraboloid is the reflector of a parabolic antenna which can be utilized in accordance with the invention in all domains it is usually applied, provided that the source S is not secured to the directrix passing through the focus F.

Thus, the mentioned application to a radiobroadcasting satellite does not restrict the application of the method according to the invention, since it is only one example thereof.

In this spirit, any adaptations of the invention would remain within its scope defined in the appended claims.

We claim:

1. A method of correcting transverse defocalization of a paraboloid when the latter must be orientated with respect to the source into which the focus initially merges, consisting of:

securing said paraboloid to a first platform perpendicular to the symmetrical axis through said focus;

articulating said first platform transversely by means of two double hinges articulated in parallel to a second platform;

articulating said second platform on its lateral sides and orthogonally by means of two double hinges articulated in parallel to the fixed portion;

orienting said double hinges jointly substantially in the direction of said paraboloid focus initially merged into the source;

providing means for moving said platforms;

servo-controlling said moving means by a pointing error detecting system;

whereby the transverse defocalization of the paraboloid is corrected permanently by constantly maintaining its focus in the immediate proximity of the source.

2. A method as claimed in claim 1, wherein said double hinges are oriented differently to the symmetrical axis of the paraboloid, substantially in the direction of the focus initially merged into the source.

3. A method as claimed in claim 1, wherein said platforms are disposed between the source and the fixed portion.

4. A method as claimed in claim 1, wherein said platforms are disposed behind the fixed portion in respect to the source.

5. A method as claimed in claim 1, wherein the symmetrical axis of the paraboloid is off-centered relative to the middle of said platforms.

6. A parabolic antenna corrected in regard to transverse defocalization, when it must be oriented with respect to the source into which its focus initially merges, comprising:

a first platform perpendicular to the symmetrical axis passing through the parabolic focus, said first platform being secured to the parabolic antenna;

a first set of two double hinges articulated on the one side in parallel to one another to both sides of said first platform, and on the other side in parallel to one another to both sides of a second platform;

a second set of two double hinges articulated on the one side in parallel to one another to both sides of the second platform which are orthogonal relative to those sides receiving the hinges of said first set of hinges, and on the other side in parallel to one another, to the fixed portion;

electromagnetic means for moving said first and second platforms;

and servo-control means for controlling said electromagnetic means through a pointing error detector, whereby the parabolic antenna focus is maintained constantly in the immediate proximity of the source.

7. A parabolic antenna as claimed in claim 6, wherein said moving means to move the platforms comprise:

at least one flat winding laterally of each platform, the wires of said winding being perpendicular to the direction of movement of said platform;

a pair of magnets connected to the fixed portion or the part movable relative to the winding, said magnet pair bestriding each winding and mounted so that the magnetic field crosses the winding conductors to produce through Laplace's forces an amplitude of motion in either direction depending on the direction of current flow in said winding conductors;

and a servo-control unit receiving signals from said pointing error detector and supplying current proportional thereto to said windings.

8. A radiobroadcasting and/or television broadcasting satellite comprising a parabolic antenna as claimed in claim 7, wherein transverse defocalization is lower than 1 mm for a pointing error angle of about 1°.

* * * * *